US011827482B2

(12) United States Patent
Shimosaka et al.

(10) Patent No.: US 11,827,482 B2
(45) Date of Patent: Nov. 28, 2023

(54) MEDIUM CONVEYING APPARATUS INCLUDING PAIR OF GUIDES MOVABLY LOCATED ACCORDING TO CONVEYANCE OF MEDIUM

(71) Applicant: PFU LIMITED, Kahoku (JP)

(72) Inventors: Kiichiro Shimosaka, Kahoku (JP); Hirotoshi Kakuda, Kahoku (JP)

(73) Assignee: PFU LIMITED, Kahoku (JP)

( * ) Notice: Subject to any disclaimer, the term of this patent is extended or adjusted under 35 U.S.C. 154(b) by 82 days.

(21) Appl. No.: 17/099,618

(22) Filed: Nov. 16, 2020

(65) Prior Publication Data

US 2021/0188579 A1 Jun. 24, 2021

(30) Foreign Application Priority Data

Dec. 19, 2019 (JP) ..... 2019-229591

(51) Int. Cl.
*B65H 5/36* (2006.01)
*B65H 5/06* (2006.01)

(52) U.S. Cl.
CPC ..... *B65H 5/36* (2013.01); *B65H 5/062* (2013.01)

(58) Field of Classification Search
CPC .... B65H 5/36; B65H 5/062; B65H 2404/611; B65H 29/52
See application file for complete search history.

(56) References Cited

U.S. PATENT DOCUMENTS 4,262,895 A * 4/1981 Wenthe, Jr. ..... B65H 15/004 271/902
6,260,844 B1 * 7/2001 Naeser ..... B65H 5/062 271/272
8,002,276 B2 * 8/2011 Ishikawa ..... B65H 9/006 271/902

(Continued)

FOREIGN PATENT DOCUMENTS

JP 60-180247 U 11/1985
JP H10-212048 A 8/1998

(Continued)

OTHER PUBLICATIONS

Japanese Office Action dated Jul. 4, 2023 regarding Japanese Patent Application No. 2019-229591 corresponding to U.S. Appl. No. 17/099,618 (5 pages) with English Translation (9 pages).

(Continued)

*Primary Examiner* — Patrick Cicchino
(74) *Attorney, Agent, or Firm* — LEWIS ROCA ROTHGERBER CHRISTIE LLP

(57) ABSTRACT

A medium conveying apparatus includes a pair of conveyance rollers including a first roller and a second roller facing the first roller on an upward side of the first roller, to convey a medium between the first roller and the second roller, and a pair of guides including a lower guide located on an upstream side of the pair of conveyance rollers in a medium conveying direction and an upper guide facing the lower guide, to guide the medium to the pair of conveyance rollers. The upper guide is movably located upwardly according to a conveyance of the medium and the lower guide is movably located downwardly according to the conveyance of the medium so that a space between the pair of guides is changed according to the medium.

6 Claims, 9 Drawing Sheets

(56) References Cited

U.S. PATENT DOCUMENTS

| | | | | |
|---|---|---|---|---|
| 8,466,941 | B2 * | 6/2013 | Oshiro | B65H 5/38 347/179 |
| 8,550,734 | B2 * | 10/2013 | Nakayama | B65H 35/04 271/278 |
| 9,523,956 | B2 * | 12/2016 | Hunter | B65H 5/36 |
| 9,546,060 | B2 * | 1/2017 | Tashiro | B65H 5/068 |
| 9,802,776 | B2 * | 10/2017 | Fukusaka | B65H 29/62 |
| 9,851,676 | B2 * | 12/2017 | Yamaguchi | B65H 85/00 |
| 9,975,715 | B2 * | 5/2018 | Kakuta | B65H 5/36 |
| 10,647,534 | B2 * | 5/2020 | Nakata | G03G 15/70 |
| 11,161,356 | B2 * | 11/2021 | Kodama | B41J 11/0045 |
| 2021/0309475 | A1 * | 10/2021 | Kakuta | B65H 5/36 |

FOREIGN PATENT DOCUMENTS

| | | | |
|---|---|---|---|
| JP | 2001-114448 | A | 4/2001 |
| JP | 2004-189371 | A | 7/2004 |

OTHER PUBLICATIONS

Japanese Office Action dated Sep. 25, 2023 regarding Japanese Patent Application No. 2019-229591 corresponding to U.S. Appl. No. 17/099,618 (3 pages) with English Translation (5 pages).

* cited by examiner

MEDIUM CONVEYING APPARATUS INCLUDING PAIR OF GUIDES MOVABLY LOCATED ACCORDING TO CONVEYANCE OF MEDIUM

CROSS-REFERENCE TO RELATED APPLICATIONS

This application is based upon and claims the benefit of priority of prior Japanese Patent Application No. 2019-229591, filed on Dec. 19, 2019, the entire contents of which are incorporated herein by reference.

TECHNICAL FIELD

Embodiments discussed in the present specification relate to medium conveyance.

BACKGROUND

Recently, a medium conveying apparatus, such as a scanner, is required to convey media having various thicknesses, such as a thin paper, a plastic card or a passport. In such a medium conveying apparatus, a jam of a medium is likely to occur when a thin medium such as a thin paper is conveyed, whereas a slip between a conveyance roller and a medium is likely to occur when a thick medium such as a plastic card or a passport is conveyed.

A paper guide plate of an electrophotographic copying machine to feed various types of copying sheets to a nip of a pair of rollers that constitute a fixing device is disclosed (Japanese Unexamined Patent Publication (Kokai) No. 60-180247). A step portion having a width substantially equal to a width of a small-size thick paper is provided at a front end of the paper guide plate.

A medium conveyance path having a conveyance roller, a pressure roller facing the conveyance roller, and an upper guide plate and a lower guide plate to guide a conveyed medium is disclosed (Japanese Unexamined Patent Publication (Kokai) No. 2004-189371). In this medium conveyance path, a medium guide body having a slope to guide a front end of the medium towards a clamping portion of the conveyance roller and the pressure roller is provided on the upstream side of the pressure roller a the conveying direction, and at least a position of a downstream side of the medium guide body is changeable.

SUMMARY

According to some embodiments, a medium conveying apparatus includes a pair of conveyance rollers including a first roller and a second roller facing the first roller on an upward side of the first roller, to convey a medium between the first roller and the second roller, and a pair of guides including a lower guide located on an upstream side of the pair of conveyance rollers in a medium conveying direction and an upper guide facing the lower guide, to guide the medium to the pair of conveyance rollers. The upper guide is movably located upwardly according to a conveyance of the medium and the lower guide is movably located downwardly according to the conveyance of the medium so that a space between the pair of guides is changed according to the medium.

DESCRIPTION OF EMBODIMENTS

It is to be understood that both the foregoing general description and the following detailed description are exemplary and explanatory, and are not restrictive of the invention, as claimed.

Hereinafter, a medium conveying apparatus according to an embodiment, will be described with reference to the drawings. However, it should be noted that the technical scope of the invention is not limited to these embodiments, and extends to the inventions described in the claims and their equivalents.

Figure 1:
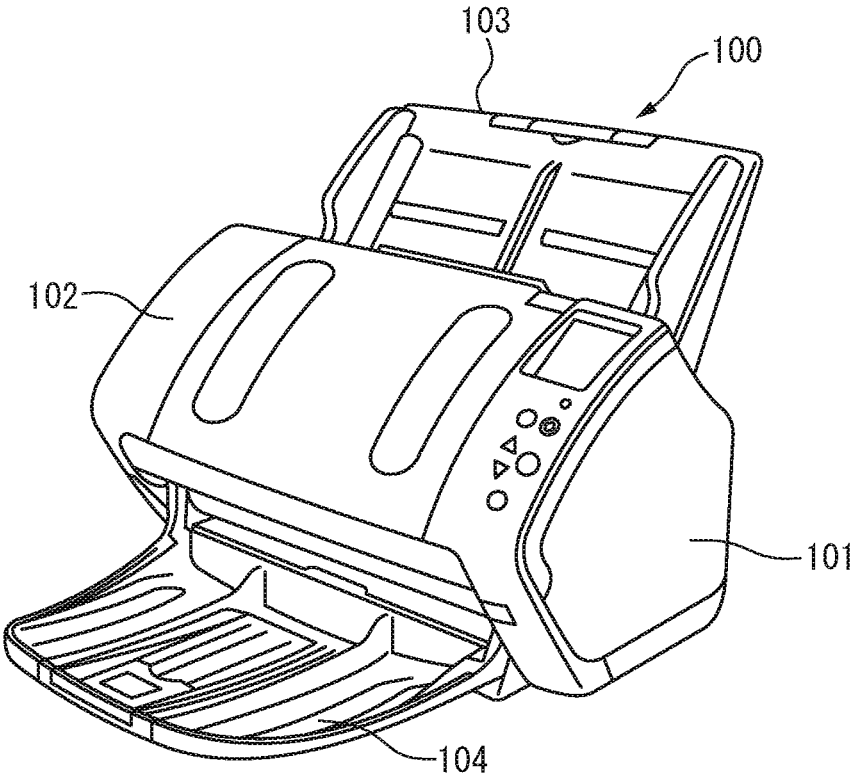
FIG. 1 is a perspective view illustrating a medium conveying apparatus 100 according to an embodiment.

FIG. 1 is a perspective view illustrating a medium conveying apparatus 100 configured as an image scanner. The medium conveying apparatus 100 conveys and images a medium being a document. The medium is a paper, such as thin paper, or a thick medium, such as a thick paper, a plastic card, a booklet or a passport (for example, a medium having a thickness larger than 2 mm). In other words, the medium supported by the medium conveying apparatus 100 includes a plurality of media each having a different thickness. The medium conveying apparatus 100 may be a fax machine, a copying machine, a multifunctional peripheral (MFP), etc. A conveyed medium may not be a document but may be an object being printed on etc., and the medium conveying apparatus 100 may be a printer etc.

The medium conveying apparatus 100 includes a lower housing 101, an upper housing 102, a medium tray 103, and an ejection tray 104, etc.

The upper housing 102 is located at a position covering the upper surface of the medium conveying apparatus 100 and is engaged with the lower housing 101 by hinges so as to be opened and closed at a time of medium jam, during cleaning the inside of the medium conveying apparatus 100, etc.

The medium tray 103 is engaged with the lower housing 101 in such away as to be able to place a medium to be conveyed. The ejection tray 104 is engaged with the lower housing 101 in such a way as to be able to hold an ejected medium.

Figure 2:
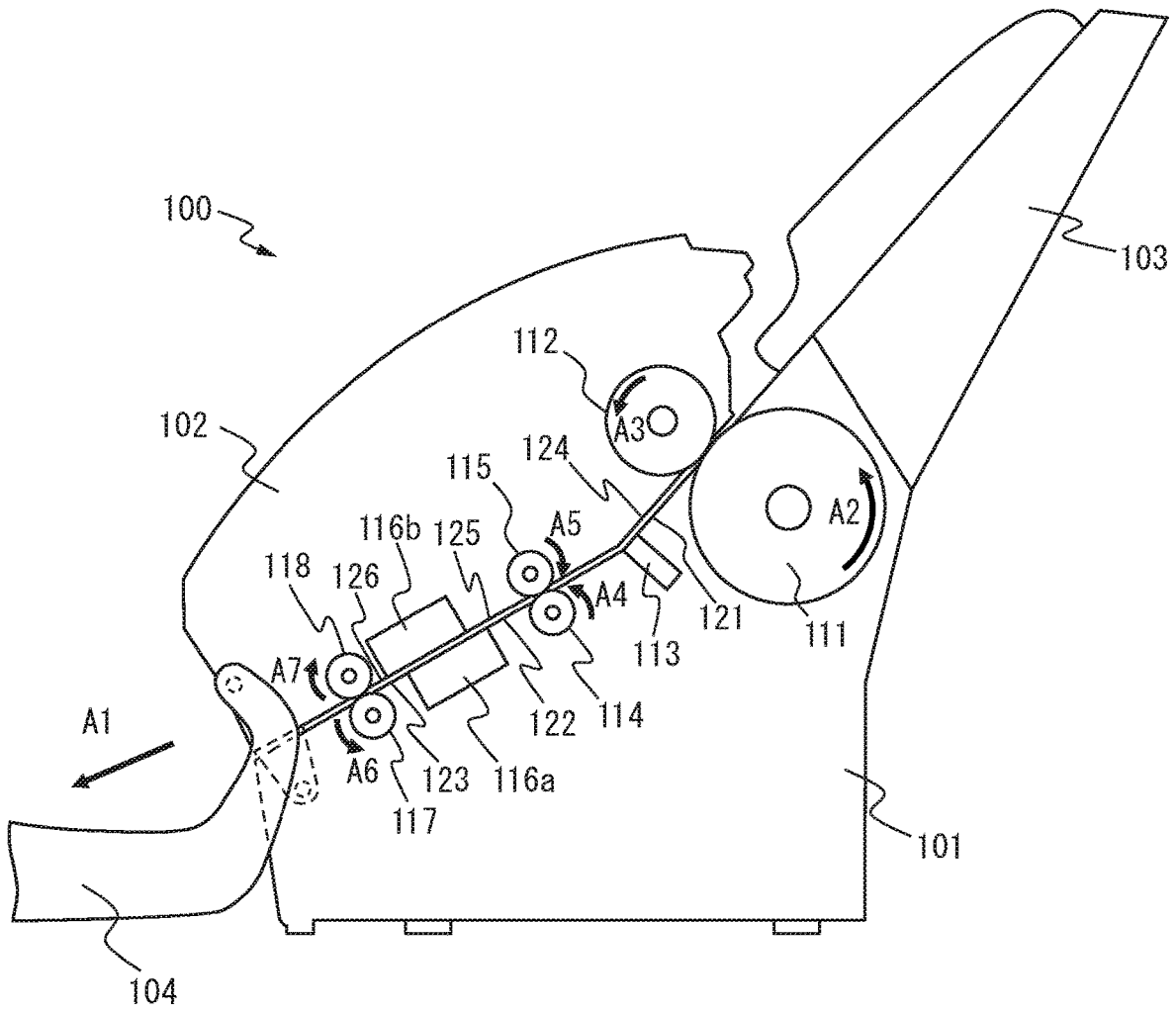
FIG. 2 is a diagram for illustrating a conveyance path inside the medium conveying apparatus 100.

FIG. 2 is a diagram for illustrating a conveyance path inside the medium conveying apparatus 100.

The conveyance path inside the medium conveying apparatus 100 includes a feed roller 111, a brake roller 112, a sensor 113, a first conveyance roller 114, a second conveyance roller 115, a first imaging device 116*a*, a second imaging device 116*b*, a third conveyance roller 117 and a fourth conveyance roller 118, etc. The numbers of each roller is not limited to one, and may be plural. An arrow A in FIG. 2 indicates a medium conveying direction. An upstream hereinafter refers to an upstream in the medium conveying direction A1, and a downstream refers to a downstream in the medium conveying direction A1.

An upper surface of the lower housing 101 forms a first lower guide 121, a second lower guide 122 and a third lower guide 123 to form a lower surface of the conveyance path of the medium. On the other hand, a lower surface of the upper housing 102 forms a first upper guide 124, a second upper guide 125 and a third upper guide 126 to form an upper surface of the conveyance path of the medium.

The first lower guide 121 is an example of a lower guide, and is located on the upstream side of the first conveyance roller 114 and the second conveyance roller 115 in the medium conveying direction A1, to guide the medium to the first conveyance roller 114 and the second conveyance roller 115. The second lower guide 122 includes an area corresponding to the first conveyance roller 114 and the second conveyance roller 115 in the medium conveying direction A1, and is located on the downstream side of the first lower guide 121 and on the upstream side of the first imaging device 116*a* and the second imaging device 116*b*. The second lower guide 122 guides the medium to the first imaging device 116*a* and the second imaging device 116*b*. The third lower guide 123 is located on the downstream side of the first imaging device 116*a* and the second imaging device 116*b*, to guide the medium to the ejection tray 104. The first lower guide 121, the second lower guide 122 and the third lower guide 123 are formed of separate members. The first lower guide 121, the second lower guide 122 and the third lower guide 123 may be formed of a single member.

The first upper guide 124 is an example of an upper guide, and is located at a position facing the first lower guide 121, to guide the medium to the first conveyance roller 114 and the second conveyance roller 115. The second upper guide 125 is located at a position facing the second lower guide 122, to guide the medium to the first imaging device 116*a* and the second imaging device 116*b*. The third upper guide 126 is located at a position facing the third lower guide 123, to guide the medium to the ejection tray 104. The first upper guide 124, the second upper guide 125 and the third upper guide 126 are formed of separate members. The first upper guide 124, the second upper guide 125 and the third upper guide 126 may be formed of a single member.

The feed roller 111 is provided on the lower housing 101 and sequentially feed media placed on the medium tray 103 from the lower side. The brake roller 112 is provided in the upper housing 102 and is located to face the feed roller 111.

The sensor 113 is located downstream of the feed roller 111 and the brake roller 112 and upstream of the first conveyance roller 114 and the second conveyance roller 115 in the medium conveying direction A. The sensor 113 detects whether or not a medium exists at the position, and detects a medium passing through between the feed roller 111 and the brake roller 112, and the first conveyance roller 114 and the second conveyance roller 115. The sensor 113 includes a light emitter and a light receiver provided on one side with respect to the conveyance path of the medium, and a reflection member such as a mirror provided at a position facing the light emitter and the light receiver with the conveyance path in between. The light emitter emits light toward the conveyance path. On the other hand, the light receiver receives light projected by the light emitter and reflected by the reflection and outputs a medium signal being an electric signal based on intensity of the received light. Since the light emitted by the light emitter is shielded by the medium when the medium is present at the position of the sensor 113, the signal value of the medium signal is changed in a state where the medium is present at the position of the sensor 113 and a state where the medium is not present. The light emitter and the light receiver may be provided at positions facing one another with the conveyance path in between, and the reflection member may be omitted.

The first conveyance roller 114 is an example of a first roller, and is provided on the lower housing 101. The second conveyance roller 115 is an example of a second roller, is provided on the upper housing 102, and is located to face the first conveyance roller 114 on an upward side of the first conveyance roller 114. The first conveyance roller 114 and the second conveyance roller 115 are located on the downstream side of the medium conveying direction A1 with respect to the feed roller 111 and the brake roller 112. The first conveyance roller 114 and the second conveyance roller 115 are examples of a pair of conveyance rollers, and convey the medium fed by the feed roller 111 and the brake roller 112 to the downstream side between the first conveyance roller 114 and the second conveyance roller 115.

The first imaging device 116*a* includes a line sensor based on a unity-magnification optical system type contact image sensor (CIS) including an imaging element based on a complementary metal oxide semiconductor (CMOS) linearly located in a main scanning direction. Further, the first imaging device 116*a* includes a lens for forming an image on the imaging element, and an A/D converter for amplifying and analog-digital (A/D) converting an electric signal output from the imaging element. The first imaging device 116*a* generates and outputs an input image imaging a front surface of a conveyed medium, in accordance with control from a processing circuit (not shown).

Similarly, the second imaging device 116*b* includes a line sensor based on a unity-magnification optical system type CIS including an imaging element based on a CMOS linearly located in a main scanning direction. Further, the secondary imaging device 116*b* includes a lens for forming an image on the imaging element, and an A/D converter for amplifying and A/D converting an electric signal output from the imaging element. The secondary imaging device 116*b* generates and outputs an input image imaging a back surface of a conveyed medium, in accordance with control from the processing circuit.

Only either of the first imaging device 116*a* and the second imaging device 116*b* may be located in the medium conveying apparatus 100 and only one side of a medium may be read. Further, a line sensor based on a unity-magnification optical system type CIS including an imaging element based on charge coupled devices (CCDs) may be used in place of the line sensor based on a unity-magnification optical system type CIS including an imaging element based on a CMOS. Further, a line sensor based on a reduction optical system type line sensor including an imaging element based on CMOS or CCDs.

The third conveyance roller 117 is provided on the lower housing 101. The fourth conveyance roller 118 is provided on the upper housing 102, and is located to face the third conveyance roller 117 on the upward side of the third conveyance roller 117. The third conveyance roller 117 and the fourth conveyance roller 118 are located on the downstream side of the first conveyance roller 114 and the second conveyance roller 115 in the medium conveying direction A1. The third conveyance roller 117 and the fourth conveyance roller 118 further conveys the medium conveyed by the first conveyance roller 114 and the second conveyance roller 115 to the downstream side, between the third conveyance roller 117 and the fourth conveyance roller 118.

A medium placed on the mounting table 103 is conveyed between the first lower guide 121 and the first upper guide 124 in the medium conveying direction A1 by the feed roller 111 rotating in a direction of an arrow A2 in FIG. 2, that is, the medium feeding direction. When the medium is conveyed, the brake rollers 112 rotate in a direction of an arrow A3, that is, a direction opposite to the medium feeding direction. By the workings of the feed roller 111 and the brake roller 112, when a plurality of media are placed on the medium tray 103, only a medium in contact with the feed roller 111, out of the media placed on the medium tray 103, is separated. Consequently, the medium conveying apparatus 100 operates in such a way that conveyance of a medium other than the separated medium is restricted (prevention of multi-feed).

The medium is fed between the first conveyance roller 114 and the second conveyance roller 115 while being guided by the first lower guide 121 and the second upper guide 124. The medium is fed between the first imaging device 116*a* and the second imaging device 116*b* by the first conveyance roller 114 and the second conveyance roller 115 rotating in directions of an arrow A4 and an arrow A5, respectively, while being guided by the second lower guide 122 and the second upper guide 125. The medium is read by the first imaging device 116*a* and the second imaging device 116*b*. Thereafter, the medium is ejected onto the ejection tray 104 by the third conveyance roller 117 and the fourth conveyance roller 118 rotating in directions of an arrow A6 and an arrow A7, respectively, while being guided by the third lower guide 123 and the third upper guide 126.

Figure 3A:
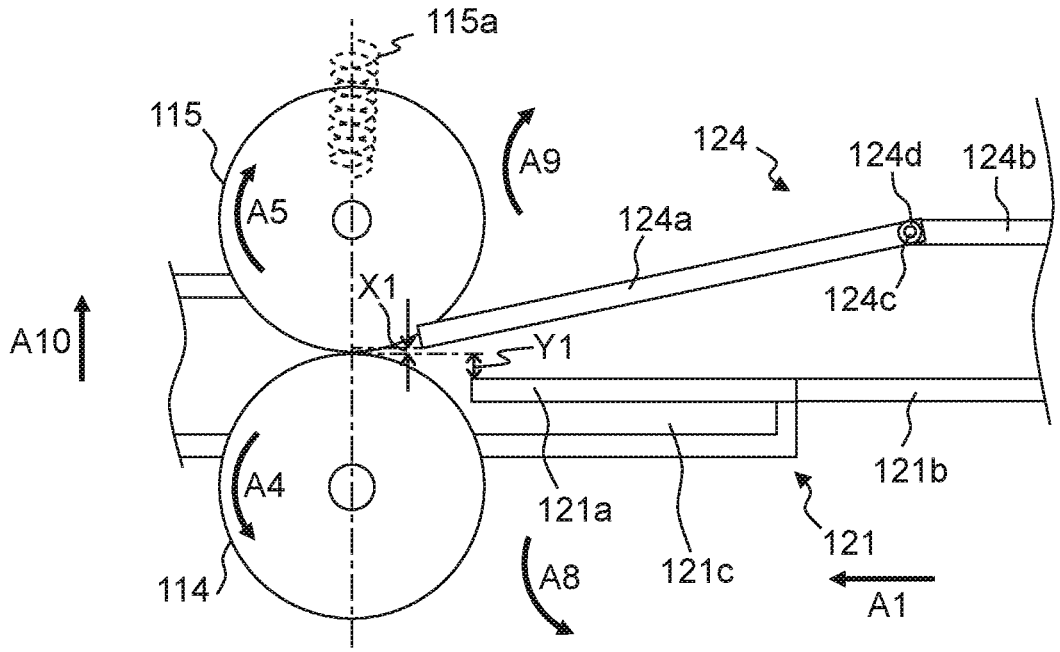
FIG. 3A is a schematic diagram for illustrating a first lower guide 121, etc.
Figure 3B:
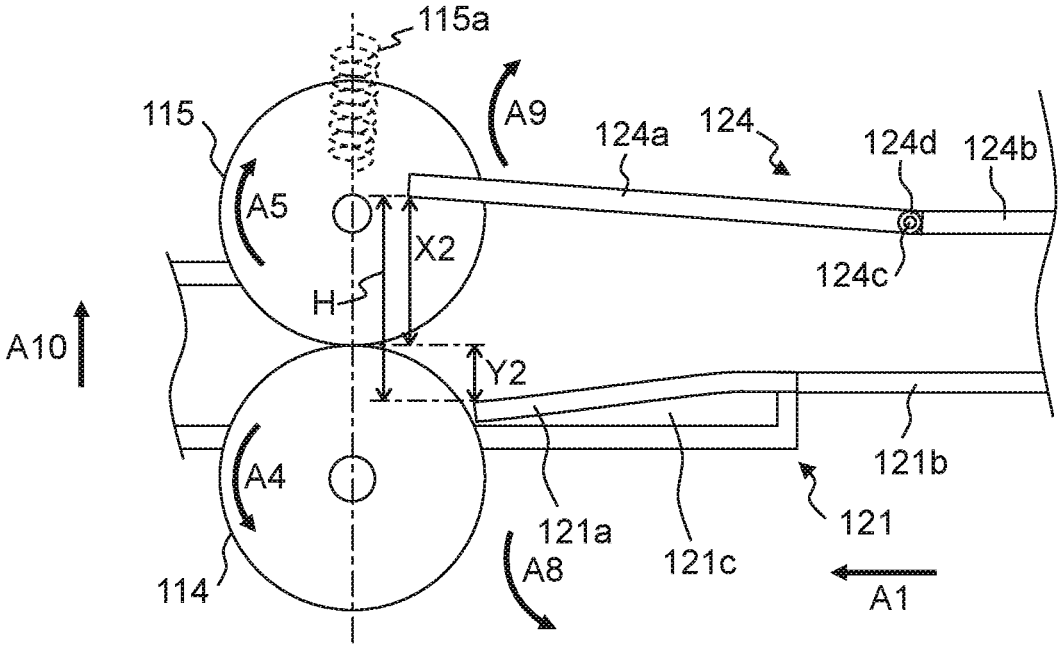
FIG. 3B is a schematic diagram for illustrating the first lower guide 121, etc.

FIGS. 3A and 3B are a schematic diagrams for illustrating the first lower guide 121 and the first upper guide 124. FIG. 3A is a schematic diagram showing a state where the first lower guide 121 and the first upper guide 124 are located at a first position which is an initial position. FIG. 3B is a schematic diagram showing a state where the first lower guide 121 and the first upper guide 124 are located at a second position in which the first lower guide 121 is moved to the lowermost end side and the first upper guide 124 is moved to the uppermost end side.

As shown in FIGS. 3A and 3B, a compression-coil spring 115*a* is provided between the upper housing 102 and a shaft which is a rotational axis of the second conveyance roller 115. The second conveyance roller 115 is movably provided upwardly by the conveyed medium, and the compression coil spring 115*a* is provided to apply a force to the second conveyance roller 115 downwardly, that is, toward the first conveyance roller 114.

The first lower guide 121 includes a first moving portion 121*a*, a first supporting portion 121*b* and a recess 121*c*. The first moving portion 121*a* is an example of a moving portion and is formed of a flexible member. The first supporting portion 121*b* is an example of a supporting portion, and supports the upstream end of the first moving portion 121*a* at the downstream end. The concave portion 121*c* is provided at a position facing the first moving portion 121*a* and on the lower side of the first moving portion 121*a*. The first moving portion 121*a* is provided so as to be movable (swingable) downward (in a direction of an arrow A8), by the first supporting portion 121*b* and the concave portion 121*c*. The first moving portion 121*a* and the first supporting part 121*b* are formed of separate members. The first moving portion 121*a* and the first supporting part 121*b* may be formed of a single member.

The first upper guide 124 includes a second moving portion 124*a* and a second supporting portion 124*b*. The second moving portion 124*a* has a protrusion 124*c* at the upstream end, and the second supporting part 124*b* has a recess at the downstream end. The front end of the protrusion 124*c* of the second moving portion 124*a* is engaged with the recess of the second supporting part 124*b* so that the second supporting part 124*b* rotatably (swingably) supports the second moving portion 124*a* at the downstream end. A torsion coil spring 124*d* is provided between the second moving portion 124*a* and the second supporting portion 124*b*. The torsion coil spring 124*d* is provided around the protrusion 124*c* so that a force is applied to the second moving portion 124*a* downwardly (in a direction opposite to an arrow A9). The second moving portion 124*a* is stopped by a stopper (not shown) so as not to move downward with respect to the first position shown in FIG. 3A. The second moving portion 124*a* is provided so as to be movable (swingable) upward (in a direction of the arrow A9) by the second supporting portion 124*b* and the torsion coil spring 124*d*.

The second moving portion 124*a* and the second supporting part 124*b* are formed of separate members. The second moving portion 124*a* and the second supporting part 124*b* may be formed of a single member. Instead of the torsion coil spring 124*d*, a compression coil spring, or a rubber member, etc., which presses the second moving portion 124*a* downward may be used.

As shown in the FIG. 3A, in a height direction A10 perpendicular to the first lower guide 121 and the first upper guide 124, the first conveyance roller 114 is provided so as to project upward with respect to the first moving portion 121*a* located at the first position. Thus, the first lower guide 121 can convey the medium so as to reliably contact the first conveyance roller 114, and the first conveyance roller 114 can suitably convey the medium. However, when a protruding amount Y1 of the first conveyance roller 114 is too large, the front end of the medium may collide with the first conveyance roller 114 substantially at a right angle, and a jam of the medium may occur. Therefore, the protruding amount Y1 of the first conveyance roller 114 is preferably as small as possible.

The protruding amount Y1 of the first conveyance roller 114 is set, for example, in a range of 0.5 mm or more and 1.0 mm or less. The protrusion amount Y1 is a distance in the height direction A10 from the downstream end of the first moving portion 121*a* located at the first position to the upper end of the first conveyance roller 114, i.e., a nip portion between the first conveyance roller 114 and the second conveyance roller 115.

Similarly, in the height direction A10, the second conveyance roller 115 is provided so as to project downward with respect to the second moving portion 124*a* located at the first position. Thus, even when the medium is deflected and floated upward, the first upper guide 124 can reliably convey the medium to the nip portion of the first conveyance roller 114 and the second conveyance roller 115, and the first conveyance roller 114 and the second conveyance roller 115 can suitably convey the medium. However, when a protruding amount X1 of the second conveyance roller 115 is too large, the front end of the medium deflected to float upward may collide with the second conveyance roller 115 substantially at a right angle, and a jam of the medium may occur. Therefore, the protruding amount X1 of the second conveyance roller 115 is preferably as small as possible.

The protruding amount X1 of the second conveyance roller 115 is set, for example, in a range of 0.1 mm or more and 1.0 mm or less. The protrusion amount X1 is a distance in the height direction A10 from the downstream end of the second moving portion 124*a* located at the first position to the upper end of the first conveyance roller 114.

On the other hand, as shown in FIG. 3B, in the height direction A10, the first conveyance roller 114 is provided so as to project upward with respect to the first moving portion 121*a* located at the second position, so as to be larger than when the first moving portion 121*a* is located at the first position. When a thick medium such as a plastic card or a passport is conveyed and an area in which the medium is in contact with the first transport roller 114 is too small, a conveying force of the medium by the first transport roller 114 may be small, and the medium may slip to be not suitably conveyed. Therefore, the protrusion amount Y2 of the first conveyance roller 114 with respect to the first moving portion 121*a* located at the second position is preferably large to some extent. However, when the protruding amount Y2 of the first conveyance roller 114 is too large, the front end of the medium may collide with the first conveyance roller 114 substantially at a right angle, and a jam of the medium may occur.

The protruding amount Y2 of the first conveyance roller 114 is set within a range of, for example, ⅓ or more of the maximum thickness of the medium supported by the medium conveying apparatus 100 and ½ or less of the roller diameter of the first conveyance roller 114. The protrusion amount Y2 is more preferably set to ½ or more of the maximum thickness of the medium supported by the medium conveying apparatus 100. For example, when the maximum thickness of the medium supported by the medium conveying apparatus 100 is 7 mm and the roller diameter of the first conveyance roller 114 is 16 mm, the protruding amount Y2 is set in the range of 2.3 mm or more and 8 mm or less (more preferably 3.5 mm). The protrusion amount Y2 is a distance in the height direction A10 from the downstream end of the first moving portion 121*a* located at the second position to the upper end of the first conveyance roller 114. In other words, the protrusion amount Y1 and the protrusion amount Y2 are distances in the height direction A10 from a position at which a lower end of the conveyed medium is in contact with the first conveyance roller 114 to the upper end of the first conveyance roller 114.

Further, in the height direction A10, the second conveyance roller 115 is provided so as to project downward with respect to the second moving portion 124*a* located at the second position, so as to be larger than when the second moving portion 124*a* is located at the first position. When a thick medium, such as a plastic card or a passport, is conveyed and an area where the medium is in contact with the second conveyance roller 115 is too small, a conveying force of the medium by the second conveyance roller 115 may be small, and the medium may slip to be not suitably conveyed. Therefore, the protrusion amount X2 of the second conveyance roller 115 with respect to the second moving portion 124*a* located at the second position is preferably large to some extent. However, when the protruding amount X2 of the second conveyance roller 115 is too large, the front end of the medium may collide with the second conveyance roller 115 substantially at a right angle, a jam of the medium may occur.

The protruding amount X2 of the second conveyance roller 115 is set within a range of, for example, the maximum thickness of the medium supported by the medium conveying apparatus 100 or more and 3/2 of the maximum thickness or less. Further, the protruding amount X2 is preferably set to ⅔ or less of the roller diameter of the second conveyance roller 115. For example, when the maximum thickness of the medium supported by the medium conveying apparatus 100 is 7 mm, the protrusion amount X2 is set in the range of 7 mm or more and 10.5 mm or less (e.g., 10 mm). The protrusion amount X2 is a distance in the height direction A10 from the downstream end of the second moving portion 124*a* located at the second position to the upper end of the first conveyance roller 114. In other words, the protrusion amount X1 and the protrusion amount X2 are distances in the height direction A10 from a position where the upper end of the medium guided by the first upper guide 124 is in contact with the second conveyance roller 115 to the upper end of the first conveyance roller 114.

The distance H in the height direction A10 between the first moving portion 121*a* and the second moving portion 124*a* located at the second position is a sum of the protrusion amount Y2 and the protrusion amount X2, and is set within a range of 9.3 mm or more and 22 mm or less (more preferably 13.5 mm).

As described above, in the medium conveying apparatus 100, the first upper guide 124 (the second moving portion 124*a*) is movably located upwardly according to a conveyance of the medium and the first lower guide 121 (the first moving portion 121*a*) is movably located downwardly according to the conveyance of the medium. Thus, a space between the first upper guide 124 and the first lower guide 121 can be changed according to the medium. Further, the space between the first upper guide 124 and the first lower guide 121 is changed so that the distance from the position at which the lower end of the medium is in contact with the first conveyance roller 114 to the upper end of the first conveyance roller 114 (the protrusion amount Y1 and the protrusion amount Y2) is changed.

Figure 4:
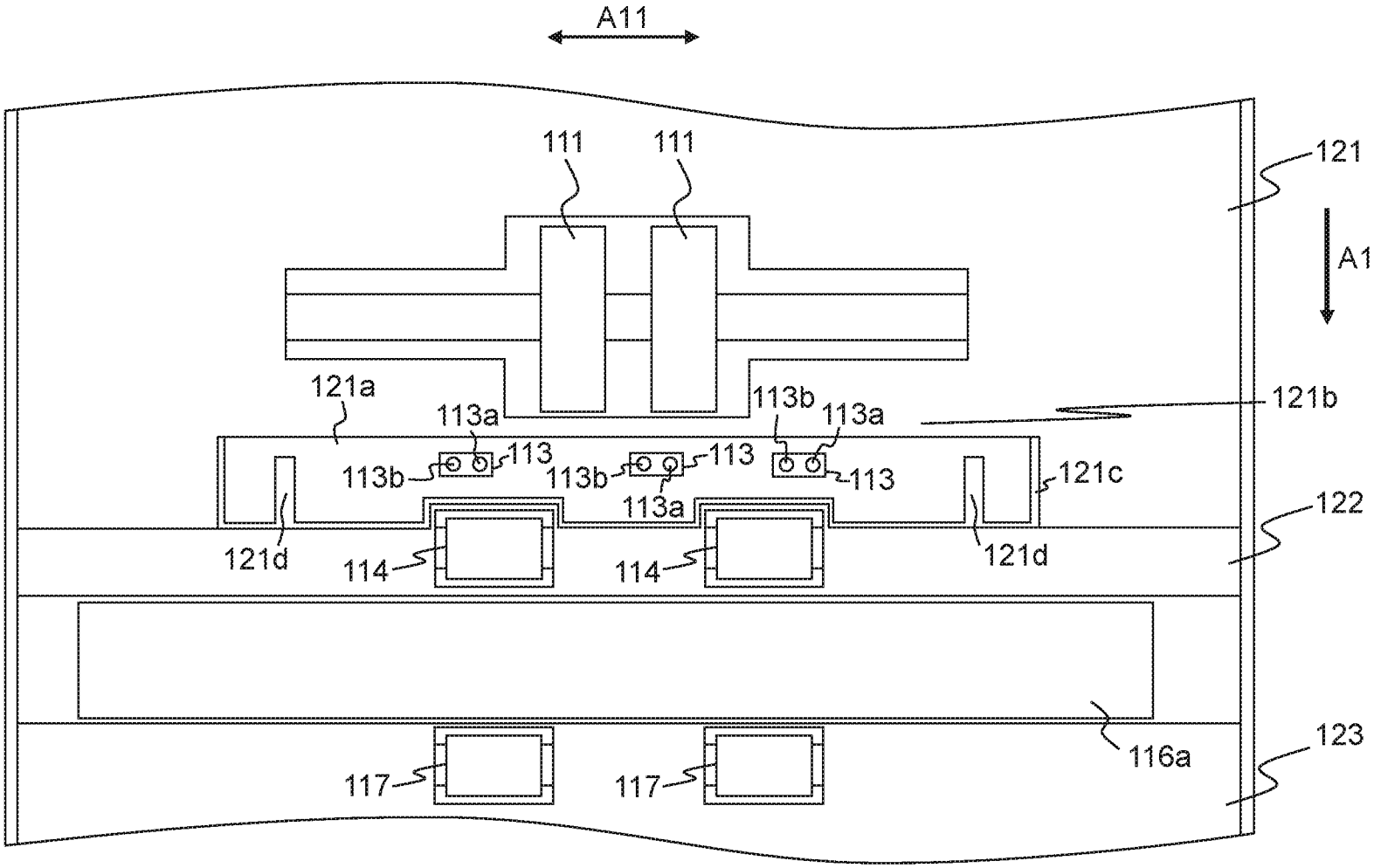
FIG. 4 is a schematic diagram for illustrating a first moving portion 121*a*.

FIG. 4 is a schematic diagram for illustrating the first moving portion 121*a*. FIG. 4 is a schematic diagram of the lower housing 101 in a state of removing the upper housing 102 viewed from above.

As shown in FIG. 4, the first lower guide 121 is located on the upstream side of the first conveyance roller 114 and the second conveyance roller 115 in the medium conveying direction A1. The first support portion 121*b* is formed on the downstream side of the feed roller 111 and the brake roller 112 in the medium conveying direction A1. The first moving section 121*a* is located between the first supporting section 121*b*, and the first conveyance roller 114 and the second conveyance roller 115 in the medium conveying direction A1.

The first lower guide 121 is formed over both ends of the medium conveyance path in the width direction A11 perpendicular to the medium conveying direction. The first moving portion 121*a* is located at a substantially central portion of the medium conveyance path in the width direction A11. Generally, a size in the width direction A11 of the thick medium, such as a plastic card or a passport, conveyed by the medium conveying apparatus is small compared to a size in the width direction A11 of a commonly used paper, such as A4 paper. Since the first moving portion 121*a* is located only at the center of the medium conveyance path, rather than over both ends, the first moving portion 121*a* moves when the thick medium is conveyed, the first moving portion 121*a* does not move when of the commonly used paper is conveyed. Thus, the medium conveying apparatus 100 can suppress an occurrence of a jam of the medium when the commonly used paper is conveyed.

In the first moving portion 121*a*, two slits 121*d* are formed at a predetermined distance from both ends in the width direction A11, respectively. As a result, the first moving section 121*a* is more flexible when the thick medium passes through, so that the first moving section 121*a* can suitably convey the thick medium. In particular, the first moving portion 121*a* is more flexible when the medium passes between the two slits 121*d*. Therefore, a distance between the two slits 121*d* is preferably set to a length acquired by adding a margin to a length of a plastic card or a passport in the width direction A11.

In the example shown in FIG. 4, a number of the sensors 113 is three. The medium conveying apparatus 100 determines whether or not a jam of the medium has occurred according to a timing at which the medium has passed through the sensor 113. Further, the medium conveying apparatus 100 determines whether or not the skew of the medium has occurred by comparing the respective timings at which the medium has passed through the three sensors 113. The first moving portion 121*a* is provided with an opening at a position facing the light emitter 113*a* and the light receiver 113*b* of each of the sensors 113. Thus, the sensors 113 can suitably detect the medium.

Figure 5A:
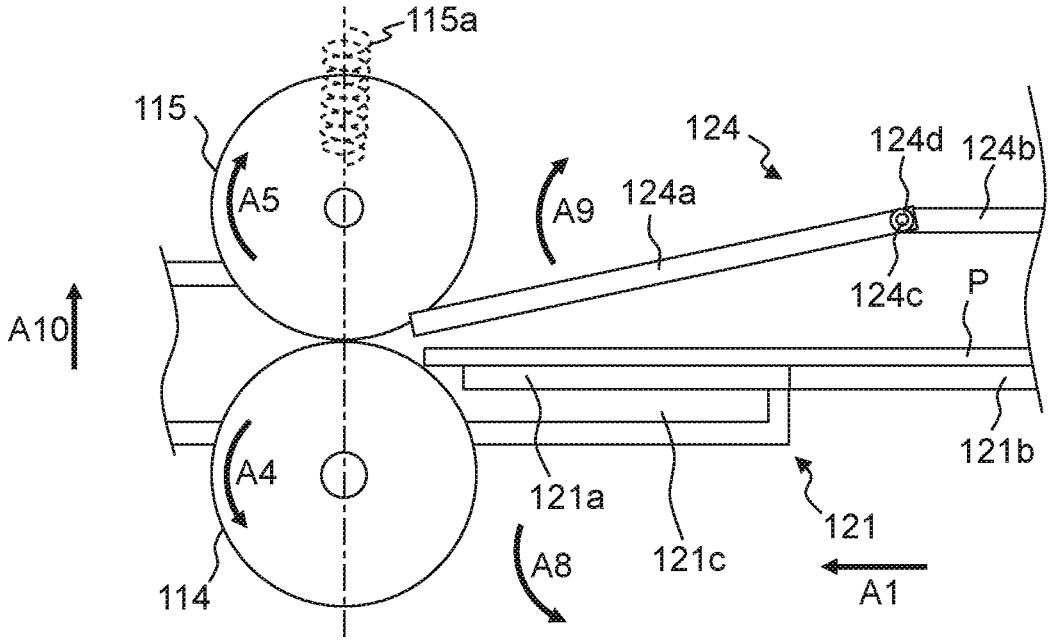
FIG. 5A is a schematic diagram for illustrating operations of the first moving portion 121*a*, etc.
Figure 5B:
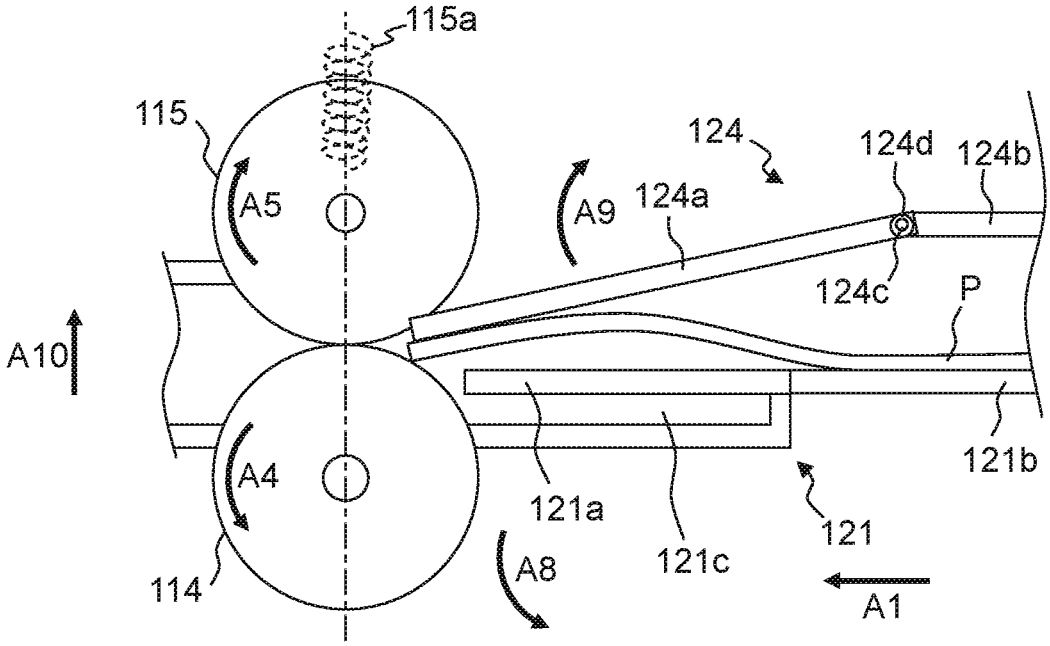
FIG. 5B is a schematic diagram for illustrating operations of the first moving portion 121*a*, etc.
Figure 6A:
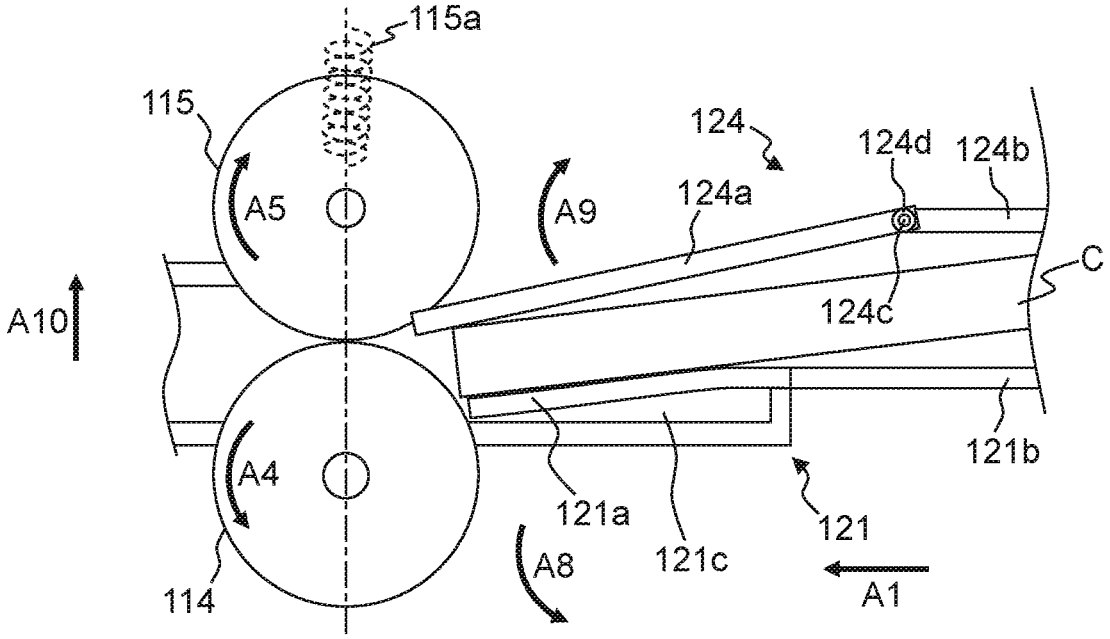
FIG. 6A is a schematic diagram for illustrating operations of the first moving portion 121*a*, etc.
Figure 6B:
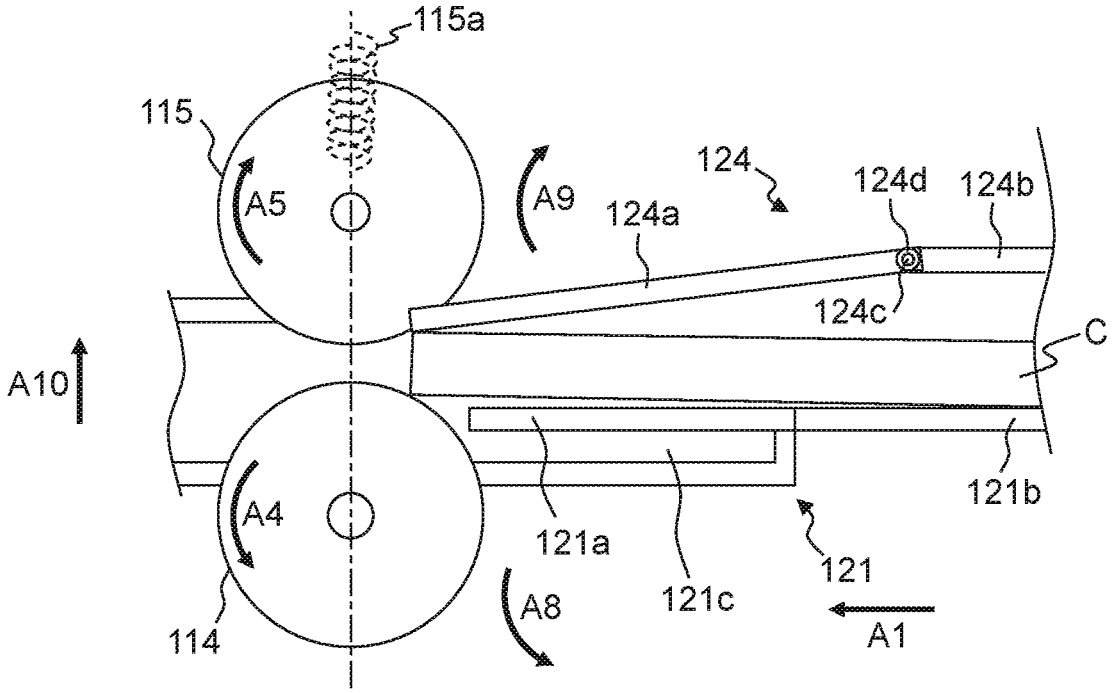
FIG. 6B is a schematic diagram for illustrating operations of the first moving portion 121*a*, etc.

FIGS. 5A, 5B, 6A and 6B are schematic diagrams for illustrating operations of the first moving portion 121*a* and the second moving portion 124*a* when the medium is conveyed. FIG. 5A is a diagram showing the first moving portion 121*a* and the second moving portion 124*a* when a paper P is conveyed as the medium. FIG. 5B is a diagram showing the first moving portion 121*a* and the second moving portion 124*a* when the paper P is conveyed as the medium and the paper P is bent upward to float up. FIG. 6A is a diagram showing the first moving portion 121*a* and the second moving portion 124*a* when a plastic card C is conveyed as the medium. FIG. 6B is a diagram showing the first moving portion 121*a* and the second moving portion 124*a* when the plastic card C is conveyed as the medium and the card C is conveyed to the nip portion of the feed roller 111 and the braking roller 112.

As shown in FIG. 5A, when the paper P is conveyed as the medium, the first moving portion 121*a* and the second moving portion 124*a* do not move from the first position. Thus, the first moving portion 121*a* guides the medium to the nip portion between the first conveyance roller 114 and the second conveyance roller 115 by contacting the medium with the first conveyance roller 114. Since the protruding amount Y1 of the first conveyance roller 114 is sufficiently small, it is unlikely that the conveyed medium collides with the first conveyance roller 114 substantially at a right angle and a jam occurs.

As shown in FIG. 5B, when the paper P is conveyed as the medium and the sheet P is bent upward to float up, the first moving portion 121*a* and the second moving portion 124*a* do not move from the first position. Thus, the second moving portion 124*a* contacts the medium floated upward with the second conveyance roller 115 or the first conveyance roller 114, and guides the medium to the nip portion of the first conveyance roller 114 and the second conveyance roller 115. Since the protruding amount X1 of the second conveyance roller 115 is sufficiently small, it is unlikely that the conveyed medium collides with the second conveyance roller 115 substantially at a right angle and a jam occurs.

As shown in FIG. 6A, when the card C is conveyed as the medium, the first moving portion 121*a* moves downward from the first position by a weight of the card C. Thus, the first moving portion 121*a* guides the medium to the first conveyance roller 114 so that the area in which the medium is contact with the first conveyance roller 114 is sufficiently large. Thus, a frictional force between the first conveyance roller 114 and the medium increases, and the first conveyance roller 114 can convey the medium with a sufficient conveying force. Further, since the first moving portion 121*a* moves downward, the card C is into contact with the second conveyance roller 115 from the lower side. Thus, the second conveyance roller 115 is suitably pushed up by the card C.

As shown in FIG. 6B, when the upper portion of the card C conveyed by the first conveyance roller 114 contacts the second moving portion 124*a*, the second moving portion 124*a* is pushed up by a thickness of the card C and moves upward from the first position. Thus, the second moving portion 124*a* guides the medium to the second conveyance roller 115 so that an area in which the medium is in contact with the second conveyance roller 115 is sufficiently large. Further, since the second moving portion 124*a* moves upward, the card C is sandwiched by the first moving portion 121*a* and the second moving portion 124*a* so as to be pressed, thereby, it is suppressed that the frictional force between the card C and the second moving portion 124*a* becomes too large. Thus, the frictional force between the second conveyance roller 115 and the medium increases and the frictional force between the medium and the second moving section 124*a* decreases, so that the medium is suitably conveyed.

Figure 7A:
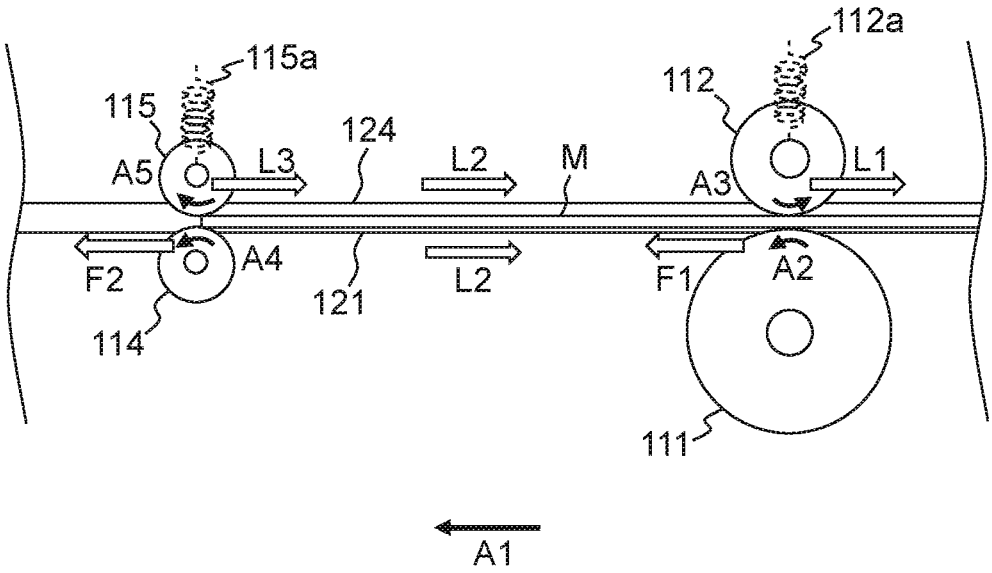
FIG. 7A is a schematic diagram for illustrating a relation between a conveying force and a conveying load of a medium.

FIG. 7A is a schematic diagram for illustrating a relation between a conveying force and a conveying load of the medium.

As shown in FIG. 7A, a first conveying force F1 corresponding to a frictional force between the feed roller 111 and the brake roller 112, and the medium M, and a pressing force by the compression coil spring 112*a* to press the brake roller 112 to the feed roller 111 side is applied to the medium M, to the medium conveying direction A1. Further, a second conveying force F2 corresponding to a frictional force between the first conveyance roller 114 and the second conveyance roller 115, and the medium M, and a pressing force by the compression coil spring 115*a* to press the second conveyance roller 115 to the first conveyance roller 114 side is applied to the medium M, to the medium conveying direction A1.

On the other hand, a first load L corresponding to a force for separating the medium by the brake roller 112 rotating in an opposite direction A3 of the medium feeding direction is applied to the medium M to the opposite direction of the medium conveying direction A1. Further, a second load L2 corresponding to a frictional force generated by the first lower guide 121 and the first upper guide 124 being in contact with the medium M is applied to the medium M, to the opposite direction of the medium conveying direction A1. Further, a third load L3 received when pushing up the second conveyance roller 115 upward is applied to the medium M, to the opposite direction of the medium conveying direction A.

When a sum of the first conveying force F1 and the second conveying force F2 is larger than a sum of the first load L1, the second load L2 and the third load L3, the medium is conveyed to the medium conveying direction A1. However, when the second conveying force F2 is sufficiently small with respect to the first conveying force F1, or when the second load L2 and/or the third load L3 are sufficiently large with respect to the first conveying force F1, the medium M may buckle and a jam of the medium may occur.

As described above, the first moving portion 121*a* moves downward by the weight of the medium M, and the second moving portion 124*a* moves upward by the thickness of the medium M. Therefore, when the medium having a predetermined weight and thickness is conveyed, the area in which the medium M is into contact with the first conveyance roller 114 and the second conveyance roller 115 increases, and the second conveying force F2 corresponding to the frictional force between the first conveyance roller 114 and the second conveyance roller 115 and the medium M increases.

In this case, the force of pressing the medium M by the first moving portion 121*a* and the second moving portion 124*a* is small, and the second load L2 corresponding to the frictional force generated by the first lower guide 121 and the first upper guide 124 being into contact with the medium M is small.

Further, the medium M is in contact with the second conveyance roller 115 from side to push up the second conveyance roller 115. As the position at which the medium M is in contact with the second conveyance roller 115 is lower, the medium M can push up the second conveyance roller 115 with a small force. The medium M can push up the second conveyance roller 115 from below by the first moving portion 121*a* moving downward by the weight of the medium M, and the third load L3 received when the second conveyance roller 115 is pushed up becomes small.

Therefore, the medium conveying apparatus 100 can suitably convey the thick medium by the first moving portion 121*a* and the second moving portion 124*a* movably provided with the thick medium.

Figure 7B:
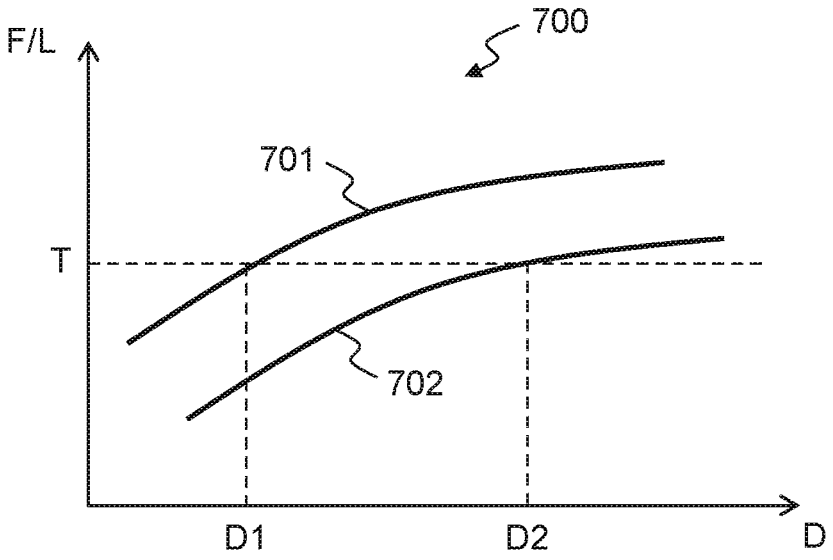
FIG. 7B is a graph 700 illustrating a relation between a force applied to a medium and an outer diameter of a roller.

FIG. 7B is a graph 700 illustrating a relation between a force applied to a medium by a roller and an outer diameter of the roller.

The horizontal axis of the graph 700 of FIG. 7B indicates a magnitude of the outer diameter of the roller, and the vertical axis indicates a ratio of a sum of the first conveying force F1 and the second conveying force F2 to a sum of the first load L1, the second load L2 and the third load L3. The graph 701 shows a ratio when rotating both the first conveyance roller 114 and the second conveyance roller 115, and the graph 702 shows a ratio when rotating only one of the first conveyance roller 114 and the second conveyance roller 115. In the graph 700, the medium is stably conveyed when the ratio is equal to or larger than a threshold T. On the other hand, the medium may not be stably conveyed when the ratio is less than the threshold T. Therefore, when rotating both the first conveyance roller 114 and the second conveyance roller 115, the outer diameter of each conveyance roller is required to be D1 or more. Further, when rotating only one of the first conveyance roller 114 and the second conveyance roller 115, the outer diameter of each conveyance roller is required to be D2 or more.

In other words, by increasing the outer diameter of the first conveyance roller 114 and the second conveyance roller 115, the ratio of the conveying force to the load increases so that the medium is suitably conveyed. However, when increasing the outer diameter of the first conveyance roller 114 and the second conveyance roller 115, the size and weight of the medium conveying apparatus 100 increases. The medium conveying apparatus 100 can suitably convey the medium without increasing the size and weight of the medium conveying apparatus 100 by the first moving portion 121*a* and the second moving portion 124*a* movably provided with a thick medium.

The ratio of the conveying force to the load by the roller is changed by not only the outer diameter of the roller, but also by a material of the roller (rubber hardness, frictional force between the roller and the medium, etc.). However, limiting the material of the roller may increase the device cost of the medium conveying apparatus 100. The medium conveying apparatus 100 can suitably convey the medium even when the material of the roller is not optimal, by the first moving portion 121*a* and the second moving portion 124*a* movably provided by the thick medium.

As described in detail above, the medium conveying apparatus 100 controls the protruding amount of the conveyance roller by moving a pair of guides provided above and below the conveyance path in the vertical direction. Thus, the medium conveying apparatus 100 suitably guides the medium so as to acquire a sufficient conveying force when the thick medium is conveyed, and so as not to cause a jam when the thin paper is conveyed. Therefore, the medium conveying apparatus 100 can suitably convey a plurality of media having different thicknesses, respectively.

Further, when conveying the medium having a thickness, the user does not need to convey the medium stored in a special sheet, etc. Therefore, the medium conveying apparatus 100 can improve the convenience of the user.

Figure 8:
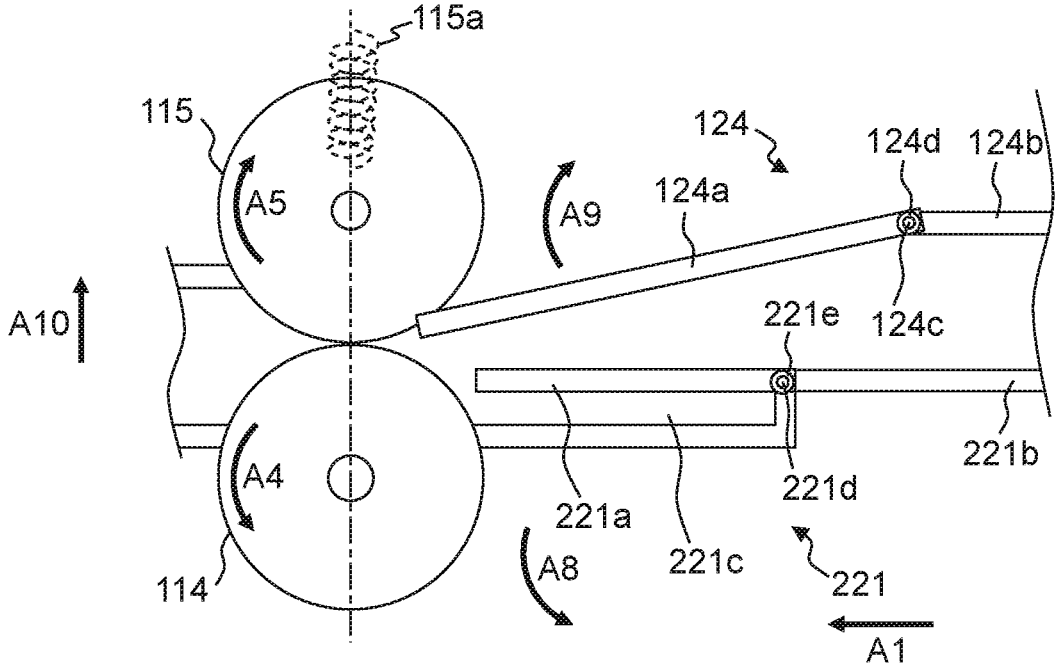
FIG. 8 is a schematic diagram for illustrating other first lower guide 221.

FIG. 8 is a schematic diagram for illustrating a first lower guide 221 in a medium conveying apparatus according to another embodiment.

As shown in FIG. 8, the medium conveying apparatus according to the present embodiment, includes a first lower guide 221, instead of the first lower guide 121. The first lower guide 221 is an example of a lower guide, and includes a first moving portion 221*a*, a first supporting portion 221*b* and a recess 221*c*. The first moving portion 221*a* is an example of a moving portion, and is formed of a resin member or a metal member, and includes a protrusion 221*d* at the upstream end. The first support portion 221*b* is an example of a support portion, and includes a recess at the end of the downstream side. A tip of the protrusion 221*d* of the first moving portion 221*a* is engaged with the recess of the first supporting portion 221*b*, so that the first supporting portion 221*b* rotatably (swingably) supports the first moving portion 221*a* at the downstream end.

A torsion coil spring 221*e* is provided between the first moving portion 221*a* and the first supporting portion 221*b*. The torsion coil spring 221*e* is provided around the protrusion 221*d* so that a force is applied to the first moving portion 221*a* upwardly (in a direction opposite to the arrow A8). The torsion coil spring 221*e* is an example of a pressing member, and presses the first lower guide 221 upward. The first moving portion 221*a* is stopped by a stopper (not shown) so as not to move upward from a first position shown in FIG. 8. The concave portion 221*c* is provided at a position facing the first moving portion 221*a* and below the first moving portion 221*a*. The first moving portion 221*a* is movably (swingably) located downwardly (in the direction of the arrow A8) by the first supporting portion 221*b*, the recess 221*c* and the torsion coil spring 221*e*.

As described in detail above, the medium conveying apparatus can suitably convey a plurality of media having different thicknesses, even when the first moving portion 221*a* is movably provided using the pressing member.

Instead of the torsion coil spring 221*e*, a compression coil spring or a rubber member, etc., may be used as the pressing member. In this case, the compression coil spring or the rubber member is provided between the first moving portion 221*a* and the concave portion 221*c* so as to press the first moving portion 221*a* upward. Further, the pressing member is omitted, the first moving portion itself may be formed of an elastic member such as rubber.

Figure 9A:
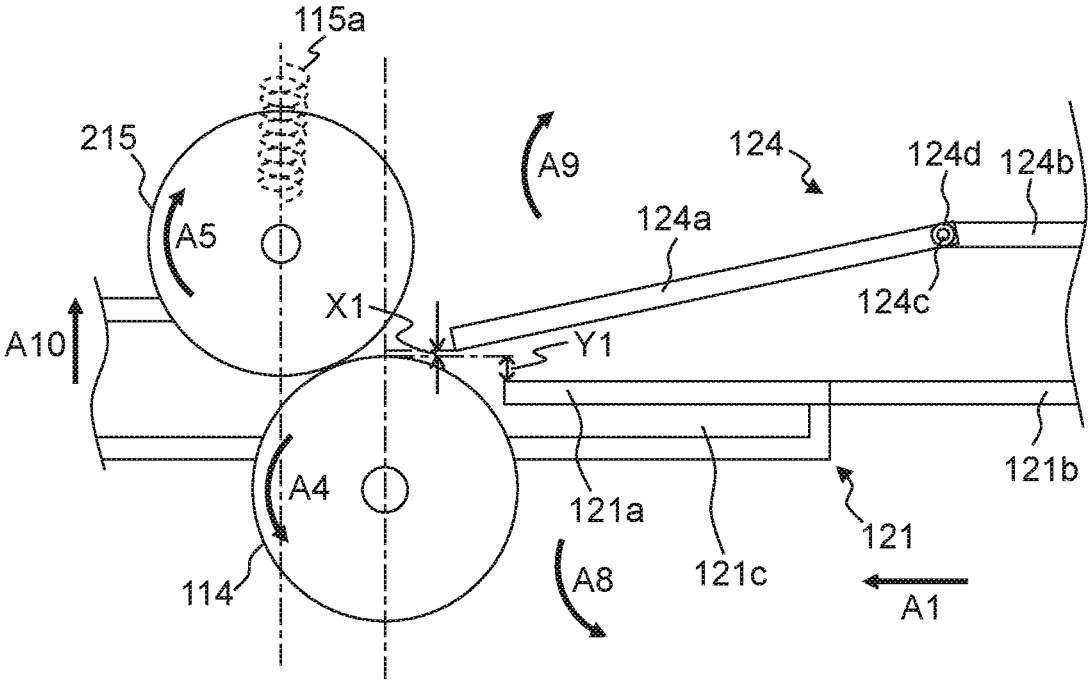
FIG. 9A is a schematic diagram for illustrating other second conveyance roller 215.
Figure 9B:
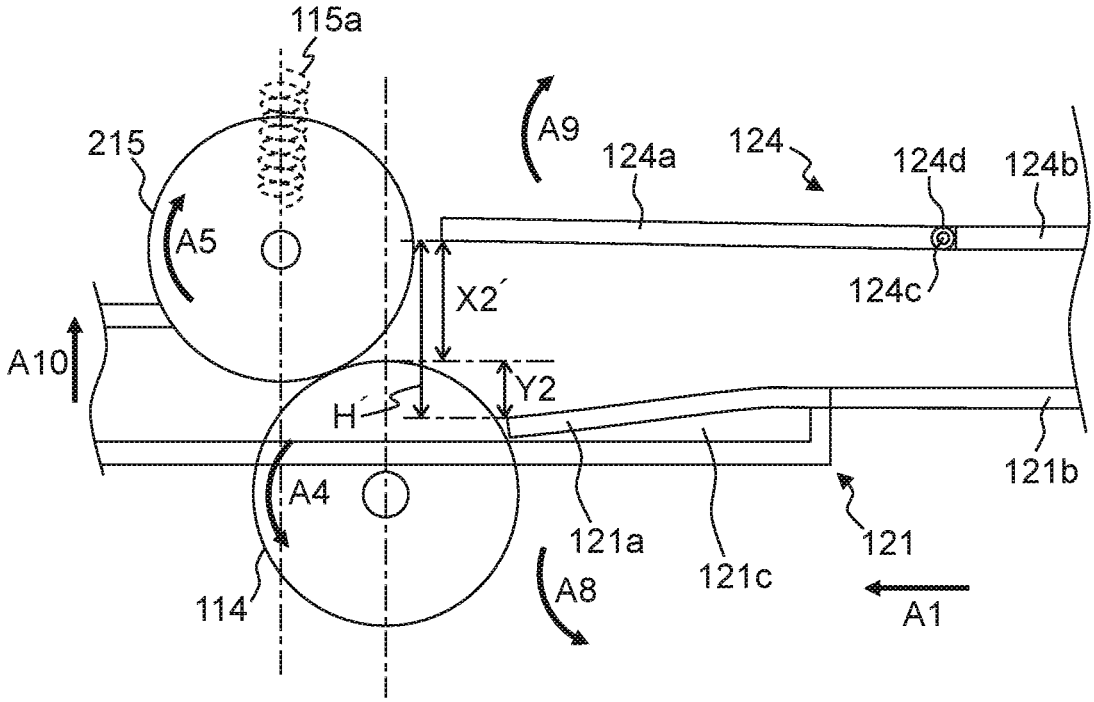
FIG. 9B is a schematic view for diagram for illustrating other second conveyance roller 215.

FIGS. 9A and 9B are schematic diagrams for illustrating the second conveyance roller 215 in a medium conveying apparatus according to still another embodiment.

As shown in FIGS. 9A and 9B, the medium conveying apparatus according to the present embodiment has a second conveyance roller 215, instead of the second conveyance roller 115. The second conveyance roller 215 is located on the downstream side of the first conveyance roller 114 in the medium conveying direction A1, i.e., on the side of the first imaging device 116*a* and the second imaging device 116*b*.

The protrusion amount Y1, the protrusion amount Y2 and the protrusion amount X1 of the medium conveying apparatus of the present embodiment are respectively set within the same ranges as the protrusion amount Y1, the protrusion amount Y2 and the protrusion amount X1 of the medium conveying apparatus 100. The protrusion amount X1 of the medium conveying apparatus of the present embodiment is, similarly to the protrusion amount X1 of the medium conveying apparatus 100, the distance in the height direction A10 from the downstream end of the second moving portion 124*a* located at the first position to the upper end of the first conveyance roller 114.

On the other hand, the protruding amount X2' of the medium conveying apparatus of the present embodiment is set to a value smaller than the protruding amount X2 of the medium conveying apparatus 100. The protrusion amount X2' of the medium conveying apparatus of the present embodiment is, similarly to the protrusion amount X2 of the medium conveying apparatus 100, the distance in the height direction A10 from the downstream end of the second moving portion 124*a* located at the second position to the upper end of the first conveyance roller 114. For example, when the second conveyance roller 215 is located to be shifted by 1 mm with respect to the first conveyance roller 114, the protruding amount X2' is set within a range of ⅔ or more and ⅘ or less of the maximum thickness of the medium supported by the medium conveying apparatus. Further, the protruding amount X2' is preferably set to ⅔ or less of the roller diameter of the second conveyance roller 215. For example, when the maximum thickness of the medium supported by the medium conveying apparatus 100 is 7 mm, the protrusion amount X2' is set in a range of 4.7 mm or more and 9.3 mm or less (e.g., 7 mm).

The distance H' in the height direction A10 between the first moving portion 121*a* and the second moving portion 124*a* located at the second position is a sum of the protrusion amount Y2 and the protrusion amount X2', and is set within a range of 7.0 mm or more and 17.3 mm or less (more preferably, 10.5 mm).

When the second conveyance roller 215 is located to be shifted to the downstream side of the first conveyance roller 114 in the medium conveying direction A1, the medium is conveyed so as to ride on the first conveyance roller 114, so that the area in which the medium is in contact with the first conveyance roller 114 increases. Therefore, the frictional force between the first conveyance roller 114 and the medium increases, so that the first conveyance roller 114 can convey the medium with a sufficient conveying force. Therefore, even when the protrusion amount X2' and the distance H' is smaller than the protrusion amount X2 and the distance H, the medium conveying apparatus can suitably convey the medium.

As described in detail above, the medium conveying apparatus can suitably convey a plurality of media having different thicknesses, respectively, even when the second conveyance roller 215 is located to be shifted to the downstream side of the first conveyance roller 114 in the medium conveying direction A1.

According to the embodiment, the medium conveying apparatus can suitably convey a plurality of media having different thicknesses, respectively.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A medium conveying apparatus comprising:

a pair of conveyance rollers including a first roller and a second roller facing the first roller on an upward side of the first roller, to convey a medium between the first roller and the second roller; and a pair of guides including a lower guide located on an upstream side of the pair of conveyance rollers in a medium conveying direction and an upper guide facing the lower guide, to guide the medium to the pair of conveyance rollers, wherein the upper guide is configured to move upward according to a conveyance of the medium, and the lower guide is configured to move downward according to the conveyance of the medium so that a space between the pair of guides is changed according to the medium and a position in the first roller or the second roller with which a front end of the medium is in contact, changes according to a thickness of the medium by the upper guide moving upward by an upper leading edge of the medium and the lower guide moving downward by a lower leading edge of the medium, when the medium has a thickness larger than a space between the pair of guides at a position at which the lower guide and the upper guide are the closest to each other in a state where a medium is not conveyed, and wherein a downstream end of the lower guide is positioned on a downstream side of an upstream end of the first roller, and a downstream end of the upper guide is positioned on a downstream side of an upstream end of the second roller, in the medium conveying direction.

2. The medium conveying apparatus according to claim 1, wherein the lower guide is formed of a flexible member.

3. The medium conveying apparatus according to claim 1, further comprising a pressing member to press the lower guide upward, wherein the lower guide is configured to move downward by the pressing member.

4. The medium conveying apparatus according to claim 1, wherein the lower guide includes a moving portion which is movable downward and a support portion to support the moving portion.

5. The medium conveying apparatus according to claim 1, wherein the space between the upper guide and the lower guide is changed so that a distance from a position at which a lower end of the medium is in contact with the first roller to an upper end of the first roller is changed.

6. The medium conveying apparatus according to claim 1, further comprising a pressing member, which is a spring or a rubber, to press the lower guide upward, wherein the lower guide is configured to move downward by the pressing member.

* * * * *